US006592688B2

(12) United States Patent
Jin et al.

(10) Patent No.: US 6,592,688 B2
(45) Date of Patent: Jul. 15, 2003

(54) HIGH CONDUCTIVITY ALUMINUM FIN ALLOY

(75) Inventors: Iljoon Jin, Kingston (CA); Jean-Pierre Martin, Perth Road Village (CA); Willard Mark Truman Gallerneault, Kingston (CA); Toshiya Anami, Kingston (CA); Kevin Michael Gatenby, Kings Sutton Oxon (GB); Ichiro Okamoto, Aichi (JP); Yoshito Oki, Shizuoka (JP)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/121,638

(22) Filed: Jul. 23, 1998

(65) Prior Publication Data

US 2001/0001402 A1 May 24, 2001

(51) Int. Cl.[7] ..... C22F 1/04
(52) U.S. Cl. ..... 148/551; 148/692; 148/552
(58) Field of Search ..... 148/692, 551, 148/552

(56) References Cited

U.S. PATENT DOCUMENTS

| | | | | |
|---|---|---|---|---|
| 3,989,548 A | | 11/1976 | Morris | |
| 4,021,271 A | * | 5/1977 | Roberts | 148/2 |
| 4,126,487 A | | 11/1978 | Morris et al. | |
| 4,802,935 A | * | 2/1989 | Crona et al. | 148/437 |
| 5,217,547 A | * | 6/1993 | Ishikawa et al. | 148/552 |
| 5,681,405 A | * | 10/1997 | Newton et al. | 148/551 |
| 5,985,058 A | * | 11/1999 | Selepack et al. | 148/551 |

FOREIGN PATENT DOCUMENTS

| | | | |
|---|---|---|---|
| EP | 0 637 481 A1 | | 2/1995 |
| GB | 1 524 355 | | 9/1978 |
| JP | 3100143 | | 4/1991 |
| JP | 03-100143 A | * | 4/1991 |
| JP | 09-145861 A | * | 3/1994 |
| JP | 07-070685 A | * | 3/1995 |

OTHER PUBLICATIONS

Patent abstracts of Japan vol. 018, No.344 (C–1218), Jun. 29, 1994 and JP 06 081064 A (Sky Alum Co Ltd), Mar. 22, 1994.

Patent abstracts of Japan vol. 015, No.385 (C–0871), Sep. 27, 1991 and JP 03 153835 A (Mitsubishi Alum Co Ltd), Jul. 1, 1991.

Patent abstracts of Japan vol. 1995, No. 06, Jul. 31, 1995 and JP 07 070685 A (Mitsubishi Alum Co Ltd), Mar. 14, 1995.

* cited by examiner

*Primary Examiner*—George Wyszomierski
*Assistant Examiner*—Janell Combs Morillo
(74) *Attorney, Agent, or Firm*—Cooper & Dunham LLP

(57) ABSTRACT

An improved aluminum alloy fin stock is described having both a high strength and a high thermal conductivity. The fin stock contains 1.2–1.8% Fe, 0.7–0.95% Si, 0.3–0.5% Mn, 0.3–1.2% Zn and the balance Al, and is produced by continuously strip casting the alloy at a cooling rate greater than 10° C./sec. but less than 200° C./sec., hot rolling the strip to a re-roll sheet without homogenization, cold rolling the re-roll sheet to an intermediate gauge, annealing the sheet and cold rolling the sheet to final gauge. This fin stock has a conductivity after brazing of greater than 49.8% IACS.

12 Claims, 1 Drawing Sheet

HIGH CONDUCTIVITY ALUMINUM FIN ALLOY

BACKGROUND OF THE INVENTION

This invention relates to an improved aluminum alloy product for use in making heat exchanger fins, and more particularly to a fin stock material having both a high strength and a high thermal conductivity.

Aluminum alloys have long been used in the production of heat exchanger fins, e.g. for automotive radiators, condensers, evaporators etc. Traditional radiator fin alloys are designed to give a high strength after brazing, a good brazability and a good sag resistance during brazing. Alloys used for this purpose usually contain a high level of manganese. An example is the aluminum alloy AA3003. Such alloys provide a good brazing performance; however, the thermal conductivity is relatively low. This low thermal conductivity was not a serious problem in the past because the major thermal barrier for fin stock was the fin-to-air heat transfer. Recently, there has been a demand for radiators having increased heat transfer efficiency. These new generation radiators require a new fin material which has a high strength as well as a high thermal conductivity.

The new fin material properties demanded by the automotive heat exchanger industry includes a high ultimate strength (UTS) after brazing, a high brazing temperature and a high conductivity for fin material having a thickness of no more than about 0.1 mm.

Morris et al., U.S. Pat. No. 3,989,548 describes an aluminum alloy containing Fe, Si, Mn and Zn. These alloys preferably are high in Mn which would result in adequate strength but poor conductivity. The alloys are not described as being useful for fin stock.

In Morris et al., British Patent 1,524,355 there are described dispersion-strengthened aluminum alloy products of the Al—Fe type which typically contain Fe, Si, Mn and Cu. The Cu is present in amounts up to 0.3% and this has a negative effect on conductivity and causes pitting corrosion, both of which would be particularly detrimental to performance of very thin fins.

An alloy that is said to be useful for heat exchange fin stock is described in Morris et al, U.S. Pat. No. 4,126,487. That aluminum alloy contains Fe, Si, Mn and Zn. It preferably also contains some Cu and Mg for added strength. As with GB 1,524,355, the Cu may be present in amounts up to 0.3%, which would be detrimental to the performance of very thin fins.

It is an object of the present invention to produce a new aluminum alloy fin stock which has both a high strength and a high thermal conductivity.

SUMMARY OF THE INVENTION

The present invention relates to a novel fin stock material that is suitable for manufacturing brazed heat exchangers using thinner fins than previously possible. This is achieved while retaining adequate strength and conductivity in the fins to permit their use in heat exchangers.

The above combination of characteristics has surprisingly been obtained according to the present invention by balancing three somewhat contradictory properties in the material, namely strength (UTS) after brazing, electrical/thermal conductivity after brazing and brazing temperature (melting point of fin material during a brazing operation).

One problem in developing this type of alloy is meeting the conductivity requirements. Thus, if the conductivity is improved by modifying a traditional alloy composition, for example by reducing the Mn content of alloy AA3003, then the strength of the alloy becomes too low. It was found that the desired balance of characteristics could be obtained by starting with a material in which there was a certain amount of particle based strengthening, which does not normally have a negative effect on conductivity. Elements were then added that contribute to solution strengthening in a carefully selected manner so as to raise the strength without lowering the conductivity or melting temperature to an extent that would make the material unusable. A microstructure was developed which provides an optimum combination of particle hardening and solid solution strengthening by introducing a high volume fraction of uniformly distributed fine intermetallic particles. To maximize the effect of particle and solution strengthening at a given composition, so that the desired properties are achieved, a high cooling rate strip casting procedure was required, but not so high as to retain excess conductivity destroying elements in solid solution.

The aluminum alloy of the invention has the composition (all percentages by weight):

| | |
|---|---|
| Fe = | 1.20–1.80 |
| Si = | 0.70–0.95 |
| Mn = | 0.30–0.50 |
| Zn = | 0.30–1.20 |
| Optionally Ti = | 0.005–0.020 |
| Others = | less than 0.05 each 0.15 total |
| Al = | balance |

The strip product formed from this alloy according to the present invention has a strength (UTS) after brazing greater than about 127 MPa, preferably greater than about 130 MPa, a conductivity after brazing greater than 49.8% IACS, preferably greater than 50.0% IACS and a brazing temperature greater than 595° C., preferably greater than 600° C.

These strip properties are measured under simulated brazed conditions as follows.

The UTS after brazing is measured according to the following procedure which simulates the brazing conditions. The processed fin stock in its final as rolled thickness (e.g. after rolling to 0.06 mm in thickness) is placed in a furnace preheated to 570° C. then heated to 600° C. in approximately 12 minutes, held (soaked) at 600° C. for 3 minutes, cooled to 400° C. at 50° C./min then air cooled to room temperature. The tensile test is then performed on this material.

The conductivity after brazing is measured as electrical conductivity on a sample processed as for the UTS test which simulates the brazing conditions, using conductivity tests as described in JIS-H0505.

BRIEF DESCRIPTION OF THE DRAWING

Appended

Figure 1:
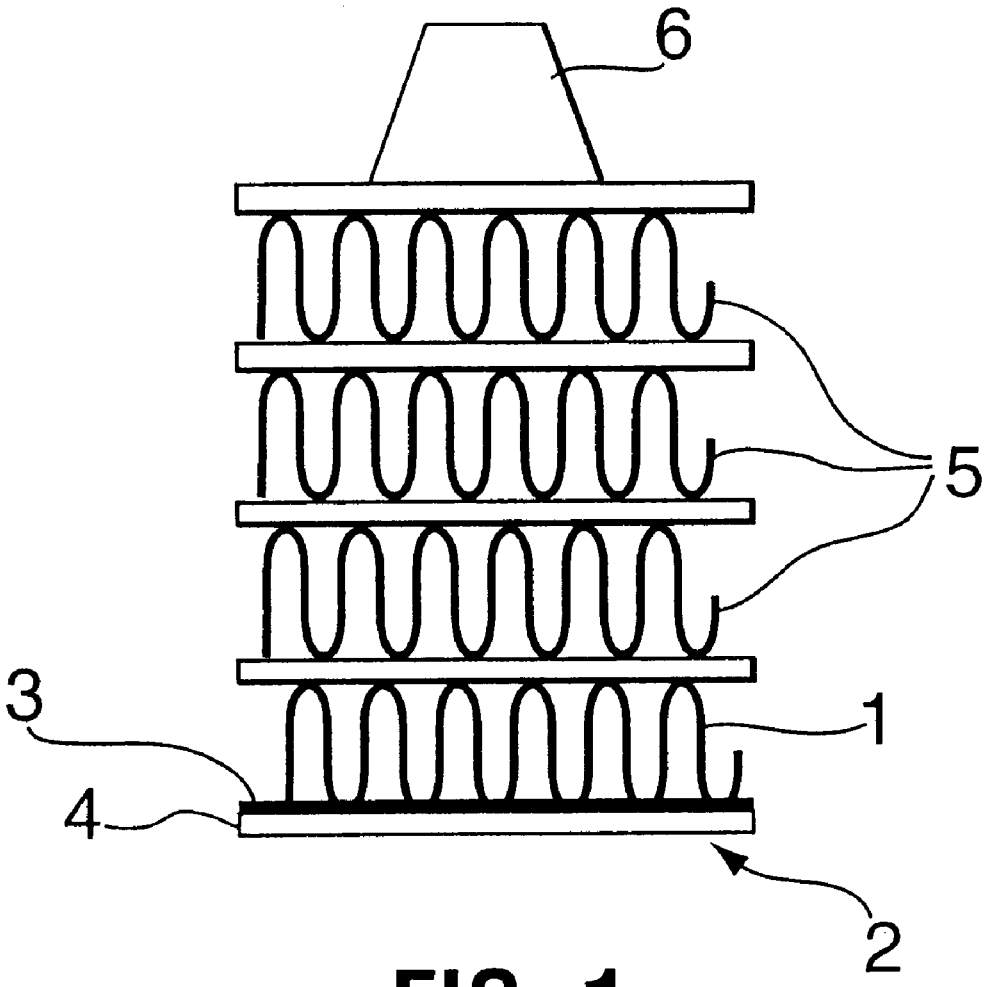
FIG. 1 is an elevation view of a test configuration for determining fin stock brazing temperature.

The brazing temperature is determined in a test configuration shown in FIG. 1 in which a corrugated fin 1 is created from the processed fin stock 2.3 mm high×21 mm wide, with a pitch of 3.4 mm. The sample is laid against a strip of tube material 2 consisting of a layer 3 of alloy AA4045 laid on a piece 4 of alloy AA3003, where the strip 2 is 0.25 mm thick and the AA4045 layer 3 is 8% of the total thickness. Nocolok™ flux is sprayed on the test assembly at a rate of 5 to 7 g/m$^2$. An additional set of three "dummy" assemblies 5 are placed on top of the test assembly, with a final sheet and a weight 6 of 98 grams on the top. The test assembly is heated to selected final test temperatures (e.g. 595° C., 600° C. or 605° C.) at 50° C./min, then held at that temperature for 3 minutes. The material has a brazing temperature of "x" when none of the corregations of the test fin melt during the test procedure at a highest final holding temperature of "x". For example, if none of the corregations of the test fin melt at a final holding temperature of 600° C., but some or all melt at a final holding temperature of 605° C., then the brazing temperature is taken as 600° C.

In order to meet the above characteristics, the alloy must be cast and formed under quite specific conditions.

Firstly, the alloy must be continuously cast at an average cooling rate greater than 10° C./sec. and less than 200° C./sec., in a casting cavity that preferably does not deform the formed slab during solidification. This slab preferably has a thickness of less than 30 mm. The cast slab is then hot rolled, cold rolled to an intermediate gauge, annealed then cold rolled to the final gauge. The cold rolling to final gauge after the anneal step preferably is at less than 60% reduction, more preferably at less than 50% reduction.

The average cooling rate means the cooling rate average through the thickness of the as cast slab, and the cooling rate is determined from the average interdendritic cell spacing taken across the thickness of the as cast slab as described for example in an article by R. E. Spear, et al. in the Transactions of the American Foundrymen's Society, Proceedings of the Sixty-Seventh Annual Meeting, 1963, Vol. 71, Published by the American Foundrymen's Society, Des Plaines, Ill., USA, 1964, pages 209 to 215. The average interdendritic cell size corresponding to the preferred average cooling rate is in the range 7 to 15 microns.

DESCRIPTION OF THE PREFERRED EMBODIMENTS

In accordance with this invention, the amounts of the individual elements in the alloy must be quite carefully controlled. The iron in the alloy forms intermetallic particles of an eutectic composition during casting that are relatively small and contribute to particle strengthening. With iron contents below 1.2%, there is insufficient iron to form the desired number of strengthening particles, while with iron contents above 1.8% large primary intermetallic phase particles are formed which prevent rolling to the desired very thin fin stock gauges.

The silicon in the alloy in the range of 0.7 to 0.95% contributes to both particle and solid solution strengthening. Below 0.7% there is insufficient silicon for this strengthening purpose while above 0.95%, the conductivity is reduced. More significantly, at high silicon contents the alloy melting temperature is reduced to the point at which the material cannot be brazed. To provide for optimum strengthening, silicon in excess of 0.8% is particularly preferred.

When manganese is present in the range of 0.3 to 0.5%, it contributes significantly to the solid solution strengthening and to some extent to particle strengthening of the material. Below 0.3% the amount of manganese is insufficient for the purpose. Above 0.5%, the presence of manganese in solid solution becomes strongly detrimental to conductivity.

The zinc content, which lies between 0.3 and 1.2%, provides for corrosion protection of a heat exchanger by making the fins sacrificial by lowering the corrosion potential of the alloy. Zinc does not have a positive or negative effect on the strength or conductivity. A zinc content below 0.3% is insufficient for corrosion protection, while no increased benefits are achieved at zinc contents above 1.2%.

The titanium, when present in the alloy as $TiB_2$, acts as a grain refiner. When present in amounts greater than 0.02%, it tends to have a negative impact on conductivity.

Any incidental elements in the alloy should be less than 0.05% each and less than 0.15% in aggregate. In particular, magnesium must be present in amounts of less than 0.10%, preferably less than 0.05%, to insure brazability by the Nocolok process. Copper must be kept below 0.05% because it has a similar effect to manganese on conductivity and it also causes pitting corrosion.

In the casting procedure, if the average cooling rate is less than 10° C./sec., the intermetallic particles formed during casting will be too large and will cause rolling problems. A lower cooling rate will generally involve DC casting and homogenization and under such circumstances, elements come out of the supersaturated matrix alloy and the solution strengthening mechanism is reduced, resulting in material of inadequate strength.

If the average cooling rate exceeds 200° C./sec. the Mn in particular is retained in solid solution and this has a highly detrimental effect on conductivity.

It is also important that the alloy must be strip cast in a manner that avoids deforming the material while it is still in the "mushy" state. If deformation does occur during solidification, it results in excessive centre line segregation and problems when rolled to form very thin fin stock required for modern applications. It is also important that the casting cavity be preferably elongated since the high Si in the present alloy results in a long freezing range which preferably requires an elongated casting cavity to solidify properly, This means, effectively, that roll casting will not produce a good product and that strip casting by belt or block casters is preferred.

According to a particularly preferred feature of the invention, the fin stock is produced by continuous strip casting the alloy to form a slab of 6 to 30 mm thick at a cooling rate of 10° C./sec. or higher, but less than 200° C./sec., then hot rolling the as-cast slab to 1–5 mm thick sheet, cold rolling to 0.08–0.20 mm thick sheet, annealing at 340–450° C. for 1–6 hours, and cold rolling to final gauge (0.05–0.10 mm). It is preferred that the as-cast slab enter the hot rolling process at a temperature of between about 400–550° C. The hot rolling step is important in that the thermo-mechanical process occurring during hot rolling contributes to the precipitation of manganese from solid solution which then contributes to the achievement of the desired conductivity in the final product. It is particularly preferred that the cast slab be 11 mm or greater in thickness. The final cold rolling should preferably be done using less than 60% reduction and more preferably less than 50% reduction. The amount of cold rolling in the final rolling step is adjusted to give an optimum grain size after brazing, i.e., a grain size of 30 to 80 $\mu$m. If the cold rolling reduction is too high, the UTS after brazing becomes high, but the grain size becomes too small and the brazing temperature becomes low. On the other hand, if the cold reduction is too low, then the brazing temperature is high but the UTS after brazing is too low. The preferred method of continuous strip casting is belt casting.

EXAMPLE 1

Two alloys A and B having the compositions given in Table 1 were cast in a belt caster at an average cooling rate of 40° C./sec. to a thickness of 16 mm, and were then hot-rolled to a thickness of 1 mm, coiled and allowed to cool. The re-roll sheet was then cold rolled to a thickness of either 0.10 mm (A) or 0.109 mm (B), annealed in a batch anneal furnace at 390° C. for 1 hour, then given a final cold rolling to a thickness of 0.060 mm (final cold rolling reduction of 40% for A and 45% for B). The UTS, Conductivity and brazing temperature were determined by the methods described above, and the results are shown in Table 2. Both alloys processed by continuous strip casting met the specifications for the final sheet.

EXAMPLE 2

An alloy C having a composition given in Table 1 was DC cast to an ingot (508 mm×1080 mm×2300 mm), homogenized at 480° C. and hot rolled to form a re-roll sheet having a thickness of 6 mm, then coiled and allowed to cool. The sheet was then cold rolled to 0.100 mm, annealed at 390° C. for 1 hour, then cold rolled to a final thickness of 0.060 mm (a reduction of 40% on the final cold rolling). The properties of this sheet are given in Table 2. Although the composition and rolling practice fell within the requirements of the present invention, the UTS was less than required and the brazing temperature was less than 595° C., both a consequence of casting at the low cooling rates of DC casting followed by homogenization prior to hot rolling.

EXAMPLE 3

Alloys D and E having composition as given in Table 1 were processed as in Example 1 with an initial cold rolled thickness of 0.1 mm and a final cold rolling reduction of 40%. The UTS values in Table 2 show that the low Mn and Si in these alloys produced material with inadequate strength.

EXAMPLE 4

Alloy F having a composition as given in Table 1 was processed as in Example 1 with a final cold rolling reduction of 50% to a thickness of 0.06 mm. The conductivity as given in Table 2 was low indicating the negative effect of too high Mn on the properties.

EXAMPLE 5

Alloy G having a composition as given in Table 1 was processed as in Example 1 with a final cold rolling reduction of 40% to a thickness of 0.06 mm. The brazing temperature as illustrated in Table 2 was not acceptable as the Si was too high.

EXAMPLE 6

Alloy A having a composition as given in Table 1 was processed as in Example 1 except that the alloy was cast in a belt caster at an average cooling rate of 100° C./sec. The UTS, Conductivity and brazing temperatures all lie within the acceptable ranges but the higher average cooling rate (but still within the range of the invention) tends to result in slightly higher strength and conductivity

TABLE 1

Alloy Compositions

| Example | Alloy | Silicon (% wt) | Iron (% wt) | Mn (% wt) | Zn (% wt) | Ti (% wt) |
|---|---|---|---|---|---|---|
| 1 & 6 | A | 0.92 | 1.52 | 0.40 | 0.51 | 0.013 |
| 1 | B | 0.85 | 1.54 | 0.41 | 0.45 | 0.013 |
| 2 | C | 0.80 | 1.51 | 0.33 | 0.53 | 0.020 |
| 3 | D | 0.59 | 1.36 | 0.0 | 0.59 | 0.0 |
| 3 | E | 0.59 | 1.39 | 0.21 | 0.57 | 0.0 |

TABLE 1-continued

Alloy Compositions

| Example | Alloy | Silicon (% wt) | Iron (% wt) | Mn (% wt) | Zn (% wt) | Ti (% wt) |
|---|---|---|---|---|---|---|
| 4 | F | 0.80 | 1.56 | 0.52 | 0.46 | 0.01 |
| 5 | G | 0.97 | 1.50 | 0.11 | 0.48 | 0.01 |

Balance of alloy composition is aluminum and incidental impurities.

TABLE 2

Properties of fin stock product

| Example | Alloy | % cold reduction (final pass) | UTS (Mpa) | Conductivity (% IACS) | Brazing temperature (° C.) |
|---|---|---|---|---|---|
| 1 | A | 40 | 133 | 50.4 | 605 |
| | B | 45 | 131 | 50.7 | 605 |
| 2 | C | 40 | 125 | 50.8 | <595 |
| 3 | D | 40 | 107 | 55.5 | 605 |
| | E | 40 | 114 | 53.0 | 605 |
| 4 | F | 50 | 131 | 49.7 | 605 |
| 5 | G | 40 | 127 | 52.1 | <595 |
| 6 | A | 50 | 138 | 51.5 | 605 |

UTS and conductivity determined on samples processed as described above

What is claimed is:

1. A method of producing an aluminum alloy fin stock from an alloy comprising 1.2–1.8% Fe, 0.7–0.95% Si, 0.3–0.5% Mn, 0.3–1.2% Zn, and the balance Al, which comprises continuously strip casting the alloy at a cooling rate greater than 10° C./sec. but less than 200° C./sec., hot rolling the strip to a re-roll sheet without homogenization, cold rolling the re-roll sheet to an intermediate gauge, annealing the sheet and cold rolling the sheet to final gauge, to thereby obtain a fin stock having a conductivity after brazing greater than 49.8% IACS and an ultimate tensile strength after brazing greater than about 127 MPa.

2. A method according to claim 1 wherein the alloy contains in addition 0.005 to 0.02% Ti.

3. A method according to claim 1 wherein the slab is cast at a thickness of no more than about 30 mm.

4. A method according to claim 3 wherein the slab is cast at a thickness of about 6–30 mm.

5. A method according to claim 4 wherein the as-cast slab is hot rolled to form a 1–5 mm thick sheet.

6. A method according to claim 5 wherein the hot rolled sheet is annealed at 340–450° C. for 1–6 hours.

7. A method according to claim 1 wherein the annealed sheet is cold rolled to a final strip gauge of less than 0.10 mm.

8. A method according to claim 1 wherein the annealed sheet is cold rolled to a final strip using a reduction of less than 60%.

9. A method according to claim 1 wherein the strip casting is conducted using a belt or block caster.

10. A method according to claim 9 wherein the strip product obtained has a brazing temperature greater than 595° C.

11. A method of producing an aluminum alloy fin stock from an alloy consisting essentially of 1.2–1.8% Fe, 0.7–0.95% Si, 0.3–0.5% Mn, 0.3–1.2% Zn, less than 0.05% each of other elements with a total of less than 0.15% and the balance essentially Al, which comprises continuously strip casting the alloy at a cooling rate greater than 10° C./sec. but less than 200° C./sec., hot rolling the strip to a re-roll sheet without homogenization, cold rolling the re-roll sheet to an intermediate gauge, annealing the sheet and cold rolling the sheet to final gauge, to thereby obtain a fin stock having a conductivity after brazing greater than 49.8% IACS and an ultimate tensile strength after brazing greater than about 127 MPa.

12. A method of producing an aluminum alloy fin stock from an alloy consisting essentially of 1.2–1.8% Fe, 0.7–0.95% Si, 0.3–0.5% Mn, 0.3–1.2% Zn, 0.005–0.020 Ti, less than 0.05% each of other elements with a total of less than 0.15% and the balance essentially Al, which comprises continuously strip casting the alloy at a cooling rate greater than 10° C./sec. but less than 200° C./sec., hot rolling the strip to a re-roll sheet without homogenization, cold rolling the re-roll sheet to an intermediate gauge, annealing the sheet and cold rolling the sheet to final gauge, to thereby obtain a fin stock having a conductivity after brazing greater than 49.8% IACS and an ultimate tensile strength after brazing greater than about 127 MPa.

* * * * *